US009131814B2

(12) United States Patent
Nakamura et al.

(10) Patent No.: US 9,131,814 B2
(45) Date of Patent: Sep. 15, 2015

(54) ELECTRIC BLOWER AND ELECTRIC CLEANER USING SAME

(75) Inventors: Kazushige Nakamura, Shiga (JP); Hiroyuki Kayama, Osaka (JP); Kazuhisa Morishita, Shiga (JP); Teppei Hidekuma, Shiga (JP); Tsuyoshi Nishimura, Shiga (JP)

(73) Assignee: Panasonic Intellectual Property Management Co., Ltd. (JP)

( * ) Notice: Subject to any disclaimer, the term of this patent is extended or adjusted under 35 U.S.C. 154(b) by 368 days.

(21) Appl. No.: 13/504,316

(22) PCT Filed: Feb. 21, 2011

(86) PCT No.: PCT/JP2011/000938

§ 371 (c)(1),
(2), (4) Date: Apr. 26, 2012

(87) PCT Pub. No.: WO2011/108214

PCT Pub. Date: Sep. 9, 2011

(65) Prior Publication Data

US 2012/0219437 A1 Aug. 30, 2012

(30) Foreign Application Priority Data

Mar. 3, 2010 (JP) ..... 2010-046187

(51) Int. Cl.
*F04D 25/06* (2006.01)
*A47L 5/22* (2006.01)
(Continued)

(52) U.S. Cl.
CPC ... *A47L 5/22* (2013.01); *A47L 9/00* (2013.01); *F04D 17/025* (2013.01); *F04D 25/0606* (2013.01); *F04D 29/444* (2013.01); *F04D 29/626* (2013.01)

(58) Field of Classification Search
CPC ..... A47L 5/22; A47L 9/00; F04D 17/025; F04D 25/0606; F04D 29/444; F04D 29/626
USPC ..... 417/423.1; 416/198 R, 203
See application file for complete search history.

(56) References Cited

U.S. PATENT DOCUMENTS 6,511,300 B2 * 1/2003 Otsuka ..... 417/354
6,592,329 B1 * 7/2003 Hirose et al. ..... 416/203
(Continued)

FOREIGN PATENT DOCUMENTS

EP 1 348 872 A2 10/2003
JP 59-103999 A 6/1984
(Continued)

OTHER PUBLICATIONS

Supplementary European Search Report in corresponding European Application No. 11 75 0328, dated Jan. 8, 2014, 4 pages.
(Continued)

*Primary Examiner* — Peter J Bertheaud
*Assistant Examiner* — Dominick L Plakkoottam
(74) *Attorney, Agent, or Firm* — Brinks Gilson & Lione

(57) ABSTRACT

The impeller of an electric blower includes a front shroud, a rear shroud, sheet-metal blades, a hub part, and an inducer having a plurality of blade parts. The inducer is configured to be divided into two parts: a first inducer composed of a first hub part and first blade parts; and a second inducer composed of a second hub part and second blade parts. The first inducer is disposed such that outer-peripheral blade-tips of the first blade parts are disposed in the proximity of the front shroud, and that the upper surface of the first hub part is proximally covered by the lower surface of a fastener.

9 Claims, 17 Drawing Sheets

(51) Int. Cl.

| | |
|---|---|
| ***F04D 17/02*** | (2006.01) |
| ***F04D 29/44*** | (2006.01) |
| ***F04D 29/62*** | (2006.01) |
| ***A47L 9/00*** | (2006.01) |

(56) References Cited

U.S. PATENT DOCUMENTS

| | | | | |
|---|---|---|---|---|
| 6,779,992 | B2 | 8/2004 | Lei et al. | |
| 2003/0185682 | A1 * | 10/2003 | Lei et al. | 416/183 |

FOREIGN PATENT DOCUMENTS

| | | | | |
|---|---|---|---|---|
| JP | 05-149103 | A | 6/1993 | |
| JP | 05149103 | A * | 6/1993 | F01D 5/04 |
| JP | 07-109997 | A | 4/1995 | |
| JP | 2000-034997 | A | 2/2000 | |
| JP | 2000-045993 | A | 2/2000 | |
| JP | 3089663 | U | 10/2002 | |
| JP | 2004-308647 | A | 11/2004 | |
| JP | 2006-105121 | A | 4/2006 | |

OTHER PUBLICATIONS

International Search Report for International Application No. PCT/JP2011/000938, dated May 24, 2011, 2 pages.

English Language Translation of Search Report in corresponding Chinese Application No. 201180012196.0, dated Oct. 8, 2014, 3 pages.

* cited by examiner

ELECTRIC BLOWER AND ELECTRIC CLEANER USING SAME

This application is 3 371 application of PCT/JP2011/000938 having an international filing date of Feb. 21, 2011, which claims priority to JP2010-046187 filed Mar. 3, 2010, the entire contents of which are incorporated herein by reference.

TECHNICAL FIELD

The present invention relates to an electric blower and an electric cleaner using the blower.

BACKGROUND ART

FIG. 13 is a partial cross-sectional view of a conventional electric blower. The electric blower includes: motor 2 having rotary shaft 1, impeller 4, air guide 5, and fan case 6. Impeller 4 is secured to rotary shaft 1 by nut 3 and rotationally driven by motor 2. Air guide 5 converts flow energy of air, exhausted from impeller 4, into pressure energy. Fan case 6 accommodates impeller 4 and air guide 5.

FIG. 14 is a partial cross-sectional view of the impeller of the conventional electric blower. Impeller 4 is configured with sheet-metal rear shroud 11, front shroud 12, a plurality of sheet-metal blades 13, and resin inducer 15. Front shroud 12 is disposed with a space from rear shroud 11, and is a sheet-metal one. Sheet-metal blades 13 are fitted to and fixed between a pair of rear shroud 11 and front shroud 12. Resin inducer 15 is disposed corresponding to suction opening 14 disposed at the center of front shroud 12. Sheet-metal blades 13 are secured by calking to rear shroud 11 and front shroud 12. Moreover, resin inducer 15 is configured with hub 16 of an approximate cone shape and blade parts 17 formed on hub 16. Especially, each of blade parts 17 is of a shape having a three-dimensional curved surface so as to rectify air that flows from suction opening 14 toward sheet-metal blades 13.

FIG. 15A is a plan view of the structure of a mold for an inducer of the conventional electric blower. FIG. 15B is a side elevational view of the structure of the mold for the inducer of the electric blower. In order to obtain such a complex form, inducer 15 is formed by resin-molding which employs side-sliding molds 21 that slide approximately radially in the direction from the center toward the outer periphery sides of blade parts 17. The mold is configured with core 22, cavity 23, and side-sliding molds 21 corresponding in number to blade parts 17 (see Patent Literature 1, for example).

FIG. 16 is a partial cross-sectional view of a conventional electric blower having another configuration. As shown in FIG. 16, inducer 31 has a vertical two-way-split configuration that includes first inducer 31*a* and second inducer 31*b*. First inducer 31*a* and second inducer 31*b* are tightened together and secured to rotary shaft 33 by nut 32 (see Patent Literature 2, for example).

Moreover, FIG. 17A is a cross-sectional view of an inducer of a conventional electric blower having further another configuration. FIG. 17B is a cross-sectional view taken along line 17B-17B in FIG. 17A. Inducer 41 has a vertical two-way-split configuration that includes first inducer 41*a* and second inducer 41*b*. Recesses 43 are disposed in blade parts 42*a* of first inducer 41*a*, while projections 44 are disposed on blade parts 42*b* of second inducer 41*b*. Projections 44 are fitted with recesses 43 by shrinkage-fit, thereby securing second inducer 41*b* to first inducer 41*a* (see Patent Literature 3, for example).

In Patent Literature 1, the number of the blade parts is optimally set to six in view of the relation between the number of the blade parts and fan efficiency. However, in consideration of air-flow volume and the number of rotations, there are sometimes cases where a multi-blade configuration having more than six blade parts is preferable. Moreover, high-frequency sounds, i.e. a kind of noise generated by the electric blower, are generated outstandingly at frequencies equal to integral multiples of the product of the number of the blade parts and the number of rotations. When the number of the blade parts is small, some of the frequencies are in an audibility range of human ears, with the frequencies being equal to the integral multiples of the product of the number of the blade parts and the number of rotations. This causes nagging noises grating on user's ears; therefore, a multi-blade configuration is expected to be means for achieving lower noises.

However, in cases where the number of the blade parts is more than six, when the inlet angle of the blade parts is made small such that the blade parts are shaped in a reclining manner, the neighboring blade parts of the inducer overlap with each other. Thus, it has been a problem that the formation is impossible using the radial sliding-core as shown in FIGS. 15A and 15B, causing a large restriction on the shape to be formed.

Moreover, in the conventional configuration shown in FIG. 16, even when the number of the blade parts of inducer 31 is increased, the formation is possible because inducer 31 is configured with two vertical parts. However, since nut 32 tightens and secures first inducer 31*a* and second inducer 31*b* together, the tightening force by nut 32 is also applied to first inducer 31*a*. Therefore, unless the thickness of first inducer 31*a* is made thick to some extent or more, first inducer 31*a* is possibly broken. This causes first inducer 31*a* to be difficult to thin.

Moreover, increased thickness of first inducer 31*a* increases the pressure surfaces of the blade parts of first inducer 31*a*, which causes the root parts of the blade parts to be subjected to the force caused by air resistance. This requires countermeasures such as ones in which the blade parts are made thicker at around the root parts. As a result, there has been a problem that the cross-section area of a passage in inducer 31 becomes narrow, resulting in a reduced air-blowing efficiency.

Moreover, since the thickness of first inducer 31*a* is large, the blade parts overlap with each other in the vertical direction when the number of the blade parts is large and the inlet angle of the blade parts is small. For this reason, there has been another problem that the formation of the inducer is impossible using a simple two-plate mold composed of a cavity and a core. In addition, the conventional electric blower has been provided with no countermeasures of preventing the blade parts from moving out of position in the direction of rotary shaft 33 and in the direction along a circumference of rotary shaft 33.

Moreover, in the conventional configuration shown in FIGS. 17A and 17B, first inducer 41*a* and second inducer 41*b* are fitted with each other by shrinkage-fit. This allows the smaller thickness of first inducer 41*a*; however, it becomes impossible to form first inducer 41*a* and second inducer 41*b* using a resin. For this reason, there has been a problem that the configuration is not suitable for products manufactured in volume production.

In addition, the fitting of projections 44 with recesses 43 prevents first inducer 41*a* from moving out of position in the direction along the circumference of the rotary shaft. In the direction of the rotary shaft toward second inducer 41*b*, it is possible to prevent the first inducer from moving out of position because blade parts 42*a* hit blade parts 42*b*. However, when being exposed to force in the opposite direction, first inducer 41*a* possibly moves out of position in the direction along the circumference of the rotary shaft.

In particular, when inducer 41 having such a configuration is employed in an electric blower such as a cleaner, the opposed side to second inducer 41*b*, i.e. toward the suction side in the electric blower, is negative in pressure. Therefore, first inducer 41*a* is pulled toward the suction side, which causes the mating surfaces of first inducer 41*a* and second inducer 41*b* to move out of position in the direction of the rotary shaft. This has been a problem.

Patent Literature 1: Japanese Patent Unexamined Publication No. 2000-45993

Patent Literature 2: Japanese Patent Unexamined Publication No. S59-103999

Patent Literature 3: Japanese Patent Unexamined Publication No. H05-149103

SUMMARY OF THE INVENTION

An electric blower according to the present invention includes: a motor having a rotary shaft, and an impeller rotationally driven by the motor. The impeller includes: a front shroud having a suction opening; a rear shroud disposed with a space from the front shroud; a plurality of sheet-metal blades fitted to and fixed between a pair of the front shroud and the rear shroud; and a resin inducer disposed at the center portion of the impeller. The resin inducer has a plurality of blade parts disposed at and around a cone-shaped hub part and rectifies suction-air flow taken from the suction opening. The inducer is configured to be divided into two-parts of a first inducer and a second inducer, in the plane perpendicular to the rotary shaft. In a passage of the suction-air flow, the first inducer located upstream close to the suction opening, includes: a first hub part having a ring shape configuring the hub part; and a plurality of first blade parts configuring the blade parts. In the passage of the suction-air flow, the second inducer located downstream farther away from the suction opening than the first inducer, includes: a second hub part having a cone shape configuring the hub part; and a plurality of second blade parts configuring the blade parts. The second blade parts and the first blade parts each have a mating surface and are mated and assembled together at the respective mating surfaces. Each of the mating surfaces is provided with an engaging part at which the second blade parts and the first blade parts are mated together. The first hub part is inserted on the outer periphery of the second hub part. The second inducer is secured to the rotary shaft by a fastener, from the first hub part side. The second blade parts and the first blade parts are coupled to each other at the engaging parts. The first inducer is disposed such that outer-peripheral blade-tips of the first blade parts are disposed in the proximity of the front shroud, and that the upper surface of the first hub part is disposed to be proximally covered by the lower surface of the fastener. This configuration allows restriction of the rotary shaft from moving in the direction of the rotation.

In such the electric blower, when securing the impeller to the rotary shaft by the fastener, tightening force is not applied only to the first hub part of the first inducer. For this reason, even if the thickness of the first inducer is made thin, the possibility can be greatly reduced of the inducer being broken caused by the tightening force upon securing the inducer. As a result, a multi-blade configuration can be employed in the resin inducer, which is possible for volume production using a simply-configured mold.

Moreover, since the second blade part and the first blade parts are coupled to each other at the engaging parts, the rotary shaft is prevented from moving in the direction along the circumference of the rotary shaft. Then, problems can be avoided such as air turbulence and breakage of the blade parts which are caused by mutual out-of-position positioning of the second blade parts and the first blade parts.

DETAILED DESCRIPTION OF THE PREFERRED EMBODIMENTS

Hereinafter, a description is made of embodiments according to the present invention, with reference to the drawings. It is to be noted that the present invention is not limited to the embodiments.

First Exemplary Embodiment

Figure 1:
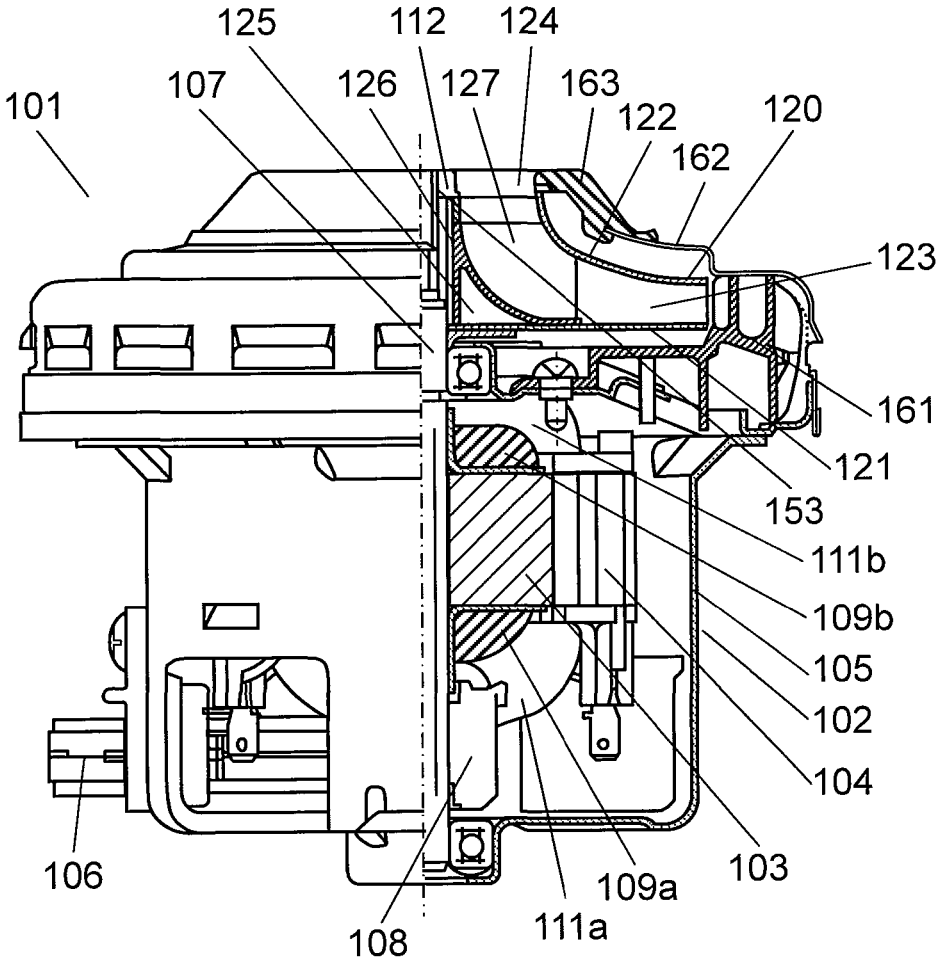
FIG. 1 is a partial cross-sectional side view of an electric blower of a first embodiment according to the present invention.

FIG. 1 is a partial cross-sectional side view of an electric blower of a first embodiment according to the present invention. Motor 102 is disposed in the electric blower 101. Motor 102, a type of motor called a brush motor, includes: rotor 103 and stator 104, bracket 105 covering the rotor and the stator, and brush part 106. Brush part 106 is disposed below rotor 103 and stator 104. In rotor 103, rotary shaft 107, commutator 108, and coils 109*a* and 109*b* are disposed. In stator 104 as well, coils 111*a* and 111*b* are disposed. Moreover, impeller 120 is coupled with rotary shaft 107 by nut 112. That is, impeller 120 is rotationally driven by motor 102.

Figure 2:
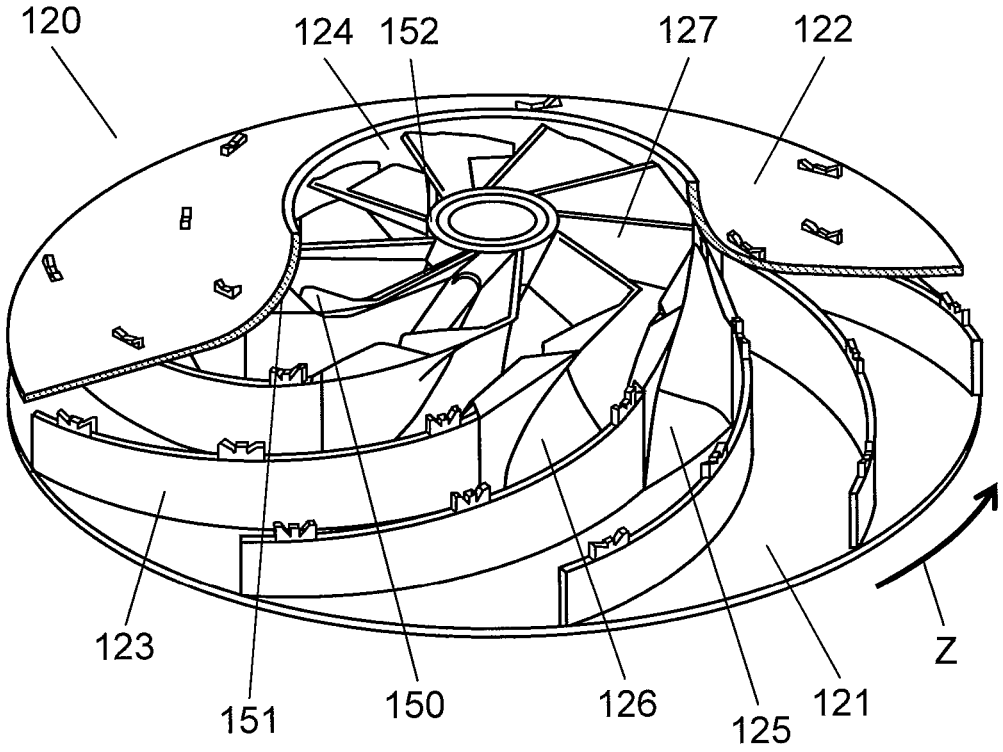
FIG. 2 is a partial cross-sectional view of an impeller of the electric blower.

FIG. 2 is a partial cross-sectional view of the impeller of the electric blower of the first embodiment according to the invention. Impeller 120 is configured including: sheet-metal rear shroud 121, sheet-metal front shroud 122, a plurality of sheet-metal blades 123, and resin inducer 125. Rear shroud 121 is a sheet-metal one disposed with a space from front shroud 122. The plurality of sheet-metal blades 123 are fitted to and fixed between a pair of rear shroud 121 and front shroud 122. Resin inducer 125 is disposed corresponding to suction opening 124 disposed at the center of front shroud 122. That is, inducer 125 is disposed at the center portion of impeller 120 so as to rectify suction-air taken from suction opening 124.

Sheet-metal blades 123 are secured by calking to the pair of rear shroud 121 and front shroud 122. Moreover, resin inducer 125 is configured with hub part 126 of an approximate cone shape, and with nine blade parts 127 located at the periphery of hub part 126. In this way, the number of blade parts 127 is so large, i.e. nine, that the neighboring blade parts will overlap with each other; therefore, the formation of such the shape is impossible when using a mold with conventional sliding cores.

Figure 3:
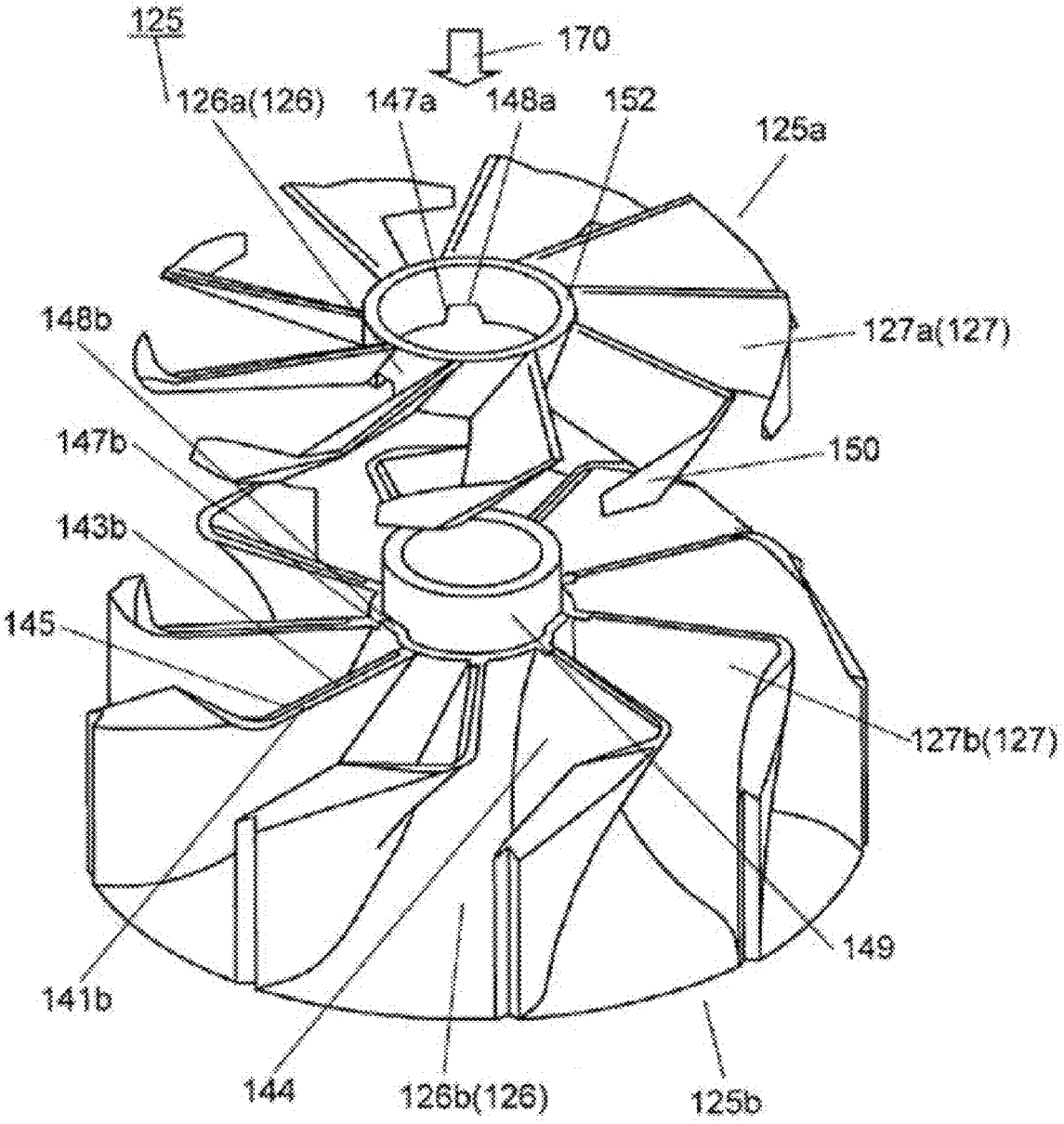
FIG. 3 is a perspective view of an inducer of the electric blower.
Figure 4:
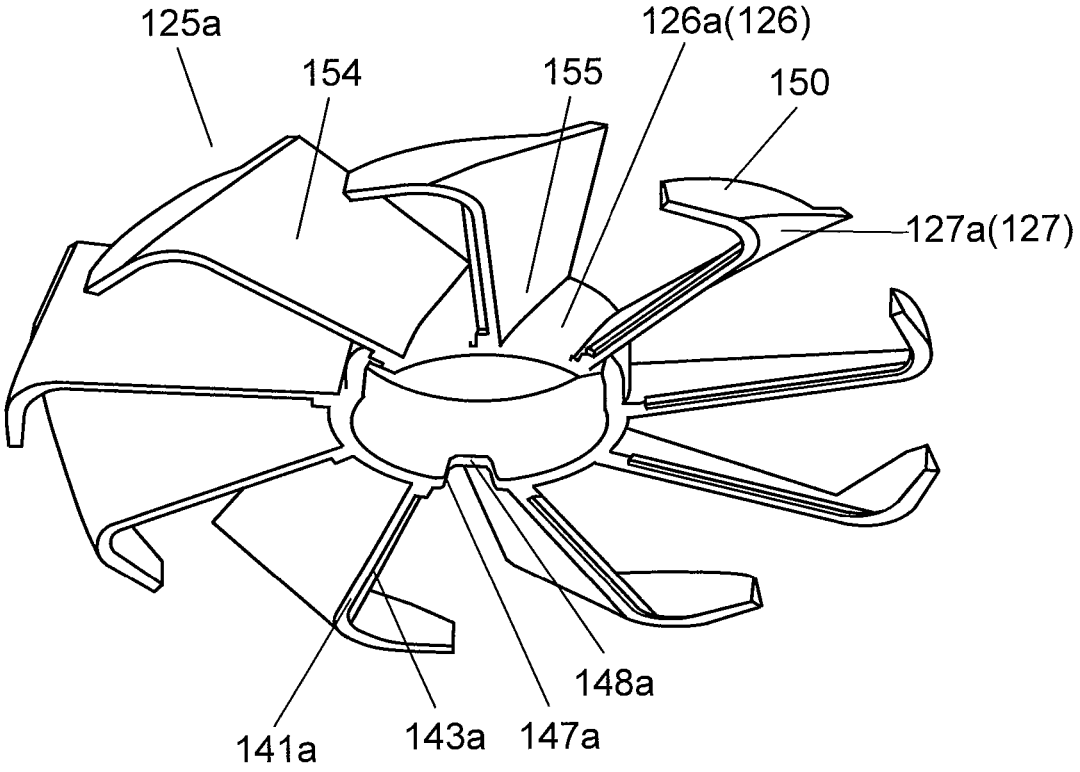
FIG. 4 is a perspective backside view of a first inducer of the electric blower.

FIG. 3 is a perspective view of the inducer of the electric blower of the first embodiment of the invention. FIG. 4 is a perspective backside view of a first inducer of the electric blower. As shown in FIGS. 3 and 4, inducer 125 is divided into two parts in a plane approximately parallel to rear shroud 121, to be configured with an upstream part, i.e. first inducer 125*a*, and a downstream part, i.e. second inducer 125*b*.

That is, inducer 125 is configured to be divided into the two parts in the plane perpendicular to rotary shaft 107 shown in FIG. 1, i.e. into first inducer 125*a* and second inducer 125*b*. Then, in passage 170 of suction-air flow, upstream first inducer 125*a* located close to suction opening 124 shown in FIG. 1 is configured with first hub part 126*b* of a ring shape and a plurality of first blade parts 127*a*. Moreover, in passage 170 of the suction-air flow, downstream second inducer 125*b* located farther away from suction opening 124 than first inducer 125*a*, is configured with second hub part 126*b* of a cone shape and a plurality of second blade parts 127*b*. The hub part 126 is configured with first hub part 126*a* and second hub part 126*b*. Blade parts 127 are configured with first blade parts 127*a* and second blade parts 127*b*.

Figure 5A:
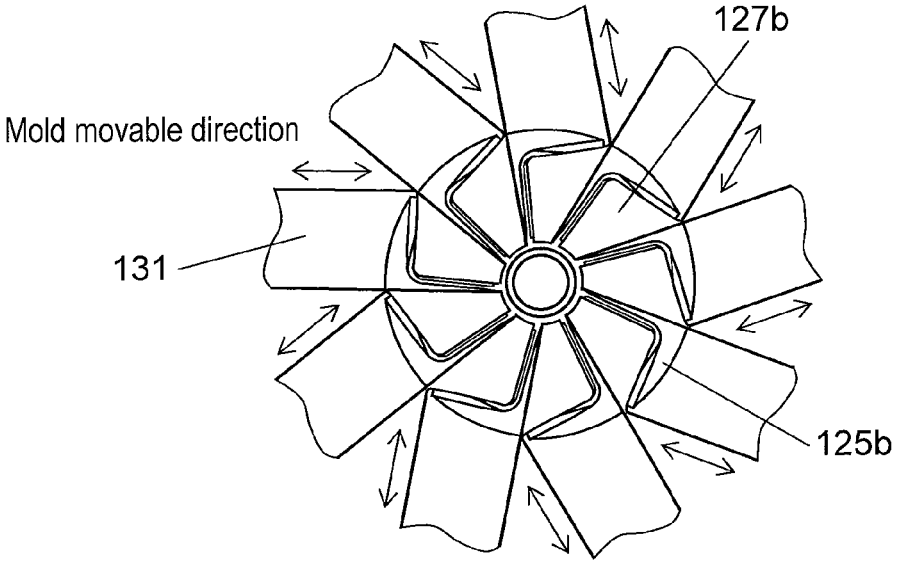
FIG. 5A is a plan view of a mold for a second inducer of the electric blower, as viewed from a suction opening.
Figure 5B:
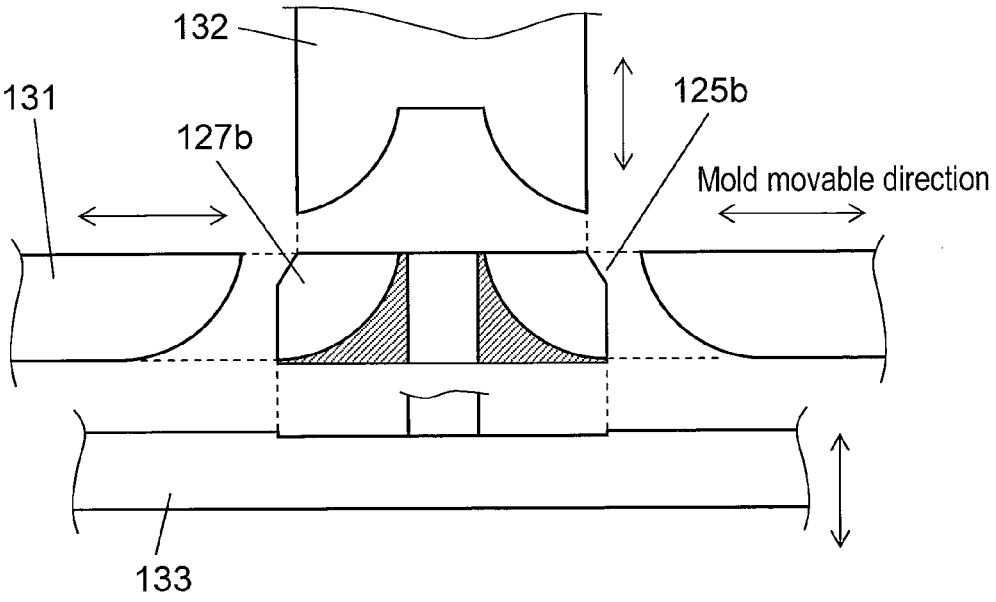
FIG. 5B is a side elevational view of the mold for the second inducer of the electric blower.

Here, the structure of a mold for second inducer 125*b* is described, with reference to FIGS. 5A and 5B. FIG. 5A is a plan view of the mold for the second inducer of the electric blower of the first embodiment of the invention, as viewed from the suction opening. FIG. 5B is a side elevational view of the mold for the second inducer of the electric blower. As shown in FIGS. 5A and 5B, the mold for second inducer 125*b* is configured with nine-way sliding molds 131 with 40-degree angular spacings, core 132, and cavity 133. As shown in FIG. 3, inducer 125 is divided into the two parts, i.e. first inducer 125*a* and second inducer 125*b*, such that neighboring second blade parts 127*b* of second inducer 125*b* do not overlap with each other. Accordingly, the shape of second inducer 125*b* is formable by using the simply-configured mold shown in FIGS. 5A and 5B.

Figure 6A:
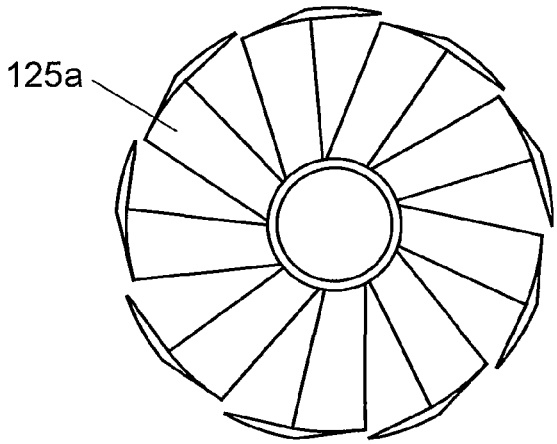
FIG. 6A is a plan view of a mold for the first inducer of the electric blower, as viewed from the suction opening.
Figure 6B:
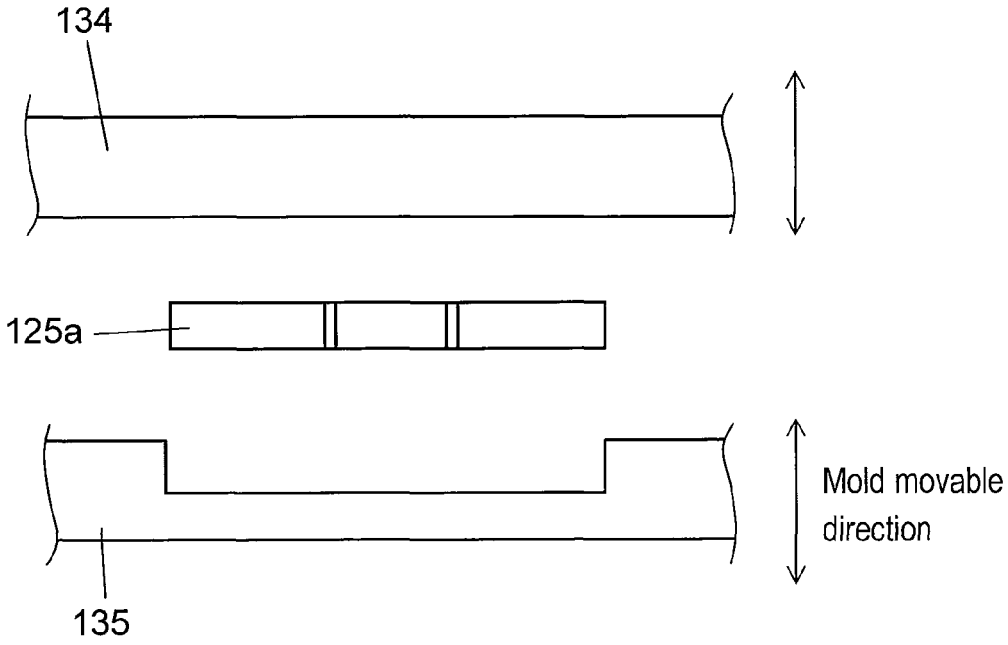
FIG. 6B is a side elevational view of the mold for the first inducer of the electric blower.

Next, the structure of a mold for first inducer 125*a* is described. FIG. 6A is a plan view of the mold for the first inducer of the electric blower of the first embodiment of the invention, as viewed from the suction opening. FIG. 6B is a side elevational view of the mold for the first inducer of the electric blower. First inducer 125*a* is configured through the use of a simplest two-plate mold having core 134 and cavity 135.

As shown in FIG. 3, since inducer 125 is configured with nine-blade parts, i.e. more than six of conventional blade parts, the inducer's shape is not formable as it is. However, by dividing into the two parts, i.e. into first inducer 125*a* and second inducer 125*b*, resin inducer 125 can be formed with the simply-configured mold that is applicable to volume production.

Figure 7:
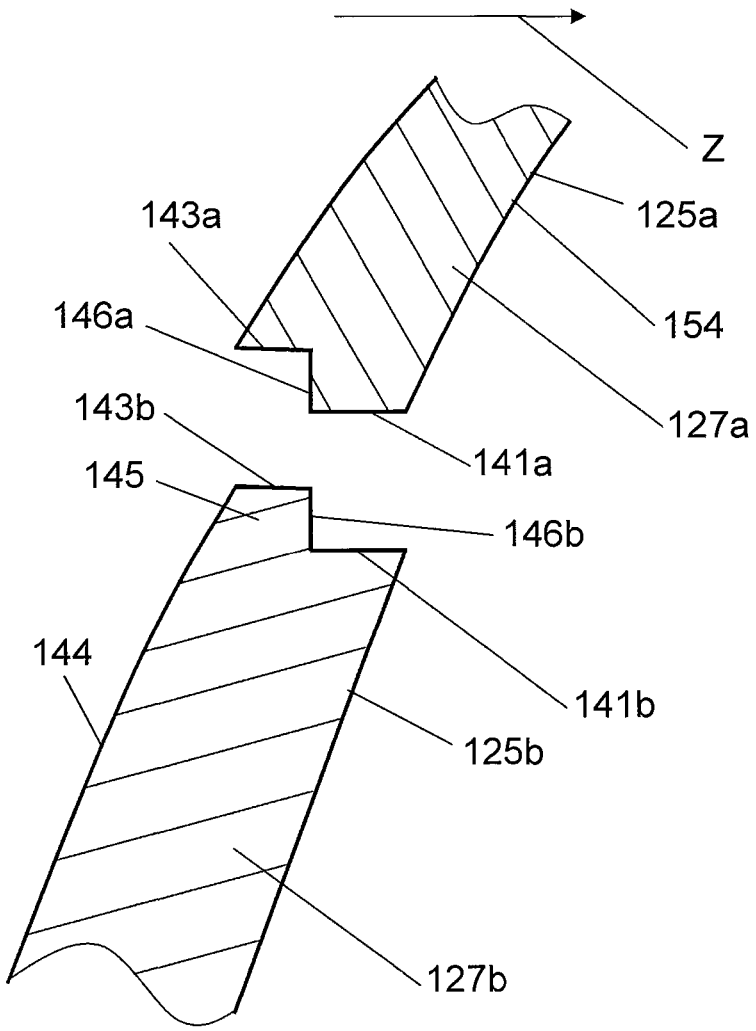
FIG. 7 is a cross-sectional view of blade parts of the electric blower.

FIG. 7 is a cross-sectional view of the blade parts of the electric blower of the first embodiment of the invention. First blade parts 127*a* of first inducer 125*a* are provided with stair-like first steps 143*a* serving as engaging parts in mating surfaces 141*a*. Moreover, second blade parts 127*b* of second inducer 125*b* are provided with stair-like second steps 143*b* serving as engaging parts in mating surfaces 141*b*. Second steps 143*b* are disposed, as first projections 145, in the negative pressure surface 144 side of second blade parts 127*b*. No tapers are disposed in respective mating surfaces 146*a* and 146*b* of first steps 143*a* and second steps 143*b*, with the mating surfaces being located in the direction along the circumference of rotary shaft 107. Respective mating surfaces 146*a* and 146*b* are configured so as to be mated with each other in an approximately vertical plane. Second blade parts 127*b* and first blade parts 127*a* are mated and assembled with each other at respective mating surfaces 141*b* and 141*a*.

Moreover, as shown in FIGS. 3 and 4, first hub part 126*a* of first inducer 125*a* and second hub part 126*b* of second inducer 125*b*, are provided with a plurality of fitting parts 148*a* and 148*b* which serve as engaging parts having tapers 147*a* and 147*b*. Fitting parts 148*a* and 148*b* are configured to be higher in the axial direction of rotary shaft 107 than first steps 143*a* and second steps 143*b* that are disposed in first blade parts 127*a* and second blade parts 127*b*, respectively.

First hub part 126*a* of first inducer 125*a* is inserted on the periphery of cylinder part 149 disposed in second hub part 126*b* of second inducer 125*b*. Then, second inducer 125*b* is secured to rotary shaft 107, from first hub part 126*a* side, by nut 112 serving as a fastener such that second blade parts 127*b* and first blade parts 127*a* are coupled and assembled with each other at fitting parts 148*a* and 148*b*. On this occasion, even when these blade parts are positioned approximately out of position, these parts are guided in place by tapers 147*a* and 147*b* disposed in fitting parts 148*a* and 148*b*. This allows easy assembling.

Then, there are assembled inducer 125 shown in FIG. 1, the pair of sheet-metal rear shroud 121 and sheet-metal front shroud 122, and sheet-metal blades 123. Thus assembled sheet-metal blades 123 are secured by caulking. This completes impeller 120. The outside diameters of first inducer 125*a* and second inducer 125*b* are configured to be larger than the inside diameter of suction opening 124 disposed at the center of front shroud 122. Therefore, first inducer 125*a* and second inducer 125*b* are impossible to slip out from suction opening 124.

Moreover, as shown in FIGS. 2 and 3, outer-peripheral blade-tips 150 of first blade parts 127*a* of first inducer 125*a* are disposed in the proximity of lower surface 151 of front shroud 122. With this configuration, first blade parts 127*a* are impossible to move out of position in the axial direction of rotary shaft 107. Moreover, upper surface 152 of first hub part 126*a* is disposed to be proximally covered by lower surface 153 of nut 112 shown in FIG. 1. Therefore, rotary shaft 107 is restricted from moving in the direction of the rotation.

Note that, if there are interstices between sheet-metal blades 123 and the pair of rear shroud 121 and front shroud 122, between first inducer 125*a* and the pair of rear shroud 121 and front shroud 122, and between second inducer 125*b* and the pair of rear shroud 121 and front shroud 122, these interstices cause a leakage of air, resulting in a loss. Accordingly, these interstices are preferably filled with adhesive or a coating material. More preferably, the interstice between first inducer 125*a* and second inducer 125*b* is also filled with adhesive or the like.

Thus assembled impeller 120 is secured to rotary shaft 107 by nut 112 as shown in FIG. 1. On this occasion, nut 112 is used such that its tightening force is not applied only to first hub part 126*a* of first inducer 125*a*. That is, the nut is adjusted to cause the tightening force to be applied simultaneously to first hub part 126*a* of first inducer 125*a* and to cylinder part 149 of second inducer 125*b*. Or alternatively, it is configured such that the tightening force is applied only to cylinder part 149 by disposing upper surface 152 of first hub part 126*a* in proximity to lower surface 153 (FIG. 1) of nut 112. That is, cylinder part 149 is made equal in height to first hub part 126*a*, or cylinder part 149 is made slightly larger in length than the first hub part.

The outside diameter of nut 112 is made larger than the inside diameter of first hub part 126*a*, and more preferably comparable to the outside diameter of first hub part 126*a*. This prevents first hub part 126*a* from disengaging from second hub part 126*b* in the axial direction of rotary shaft 107.

With these configurations, even if the thickness of first inducer 125*a* is made small in the axial direction of rotary shaft 107, first inducer 125*a* is not broken by the tightening force by nut 112. Therefore, it is possible that first inducer 125*a* is made thin and the surface area of first blade parts 127*a* is made small. Hence, force applied to pressure surfaces 154 shown in FIG. 4 becomes small, which eliminates the need for making root parts 155 of first blades parts 127*a* be thick for ensuring strength.

As a result, the cross-section area of the passage inside first inducer 125*a* is made large enough to improve air-blowing efficiency. Moreover, even if the number of blade parts 127 is large or the inlet angle of the entrance tips of first blade parts 127*a* is small, first inducer 125*a* can be made thin. Accordingly, first blade parts 127*a* can be configured so as not to overlap with each other, as viewed in the axial direction of rotary shaft 107. Then, first inducer 125*a* can be configured to have the shape formable using the simple two-plate mold with core 134 and cavity 135, as shown in FIGS. 6A and 6B.

Moreover, as shown in FIG. 1, air guide 161 is disposed at the surrounding portion of impeller 120. This allows the velocity of flow of air exhausted from impeller 120 to gradually decrease, which converts flow energy into pressure energy, resulting in an improvement in air-blowing efficiency. Then, fan case 162 made of metal accommodates impeller 120 and air guide 161. Moreover, fan case 162 is provided integrally with fan case spacer 163 made of resin. Fan case spacer 163 is configured to be sealed in contact with front shroud 122 such that the air exhausted from impeller 120 is prevented from flowing again into the inside of impeller 120 via suction opening 124.

Hereinafter, a description is made regarding operation and functions of the thus configured electric blower.

First, upon starting up electric blower 101, rotor 103 of motor 102 rotates, followed by rotation of rotary shaft 107. Impeller 120 secured to rotary shaft 107 by nut 112 rotates in the direction of arrow Z shown in FIG. 2. On this occasion, force caused by air resistance is applied to pressure surfaces 154 of blade parts 127, in the direction opposite to the rotational direction of impeller 120. Second inducer 125*b* is secured to rotary shaft 107 by tightening force by nut 112; however, first inducer 125*a* is possibly broken if a strong tightening force by nut 112 is applied thereto. For this reason, the first inducer is such that mating surfaces 141*a* and 141*b* for mating with second inducer 125*b* are possibly out of position, when the force is applied to pressure surfaces 154. This may cause air turbulence leading to a loss.

Fortunately, in the first embodiment, mating surfaces 141*a* of first blade parts 127*a* are each provided with first step 143*a*. Moreover, mating surfaces 141*b* of second blade parts 127*b* are each provided with second step 143*b*, and second blade parts 127*b* are each provided with first projection 145 in the negative pressure surface 144 side. Therefore, even if force is applied to pressure surfaces 154 of first blade parts 127*a* in the direction opposite to the rotational direction of impeller 120, mating surfaces 141*a* and 141*b* do not move out of position. Moreover, in first steps 143*a* and second steps 143*b*, no tapers are disposed in mating surfaces 146*a* and 146*b* located in the direction along the circumference of rotary shaft 107 such that these steps are mated with each other in an approximately vertical plane. Accordingly, the force applied to pressure surfaces 154 of first blade parts 127*a* is hard to disperse in the axial direction of rotary shaft 107, so that mating surfaces 141*a* and 141*b* do not move out of position in the axial direction.

Especially, in the first embodiment, front shroud 122 is sealed in contact with fan case spacer 163. In this case, blade parts 127 secured by such as adhesive to front shroud 122, and front shroud 122 are subjected to force caused by sliding friction in the direction opposite to the rotational direction of impeller 120. Therefore, the countermeasures described above are highly required.

Then, the air exhausted from impeller 120 flows into air guide 161, and then flows into the inside of bracket 105 of motor 102 so as to cool rotor 103 and stator 104.

On this occasion, when impeller 120 rotates, the sound pressure of sounds caused by the rotation becomes large at frequency equal to the product of the number of the blades and the number of rotations of impeller 120. This generates keening sounds grating on user's nerves. In particular, when the number of blades and the number of rotations are set small, e.g. the number of blades is six and the number of rotations is 600 r/s, the sound pressure becomes large at a frequency of 3.6 kHz. Since human's ears are particularly sensitive to sounds at frequencies of 3 kHz to 4 kHz, these sounds are felt unpleasant. Fortunately, in the first embodiment, since the number of blades is set to nine, the frequency at which the sound pressure becomes large is then 5.4 kHz with the same number of rotations, allowing reduced unpleasant noises.

As described above, in the first embodiment, inducer 125 is configured with the two vertical parts. Moreover, first hub part 126*a* is inserted on the outer periphery of cylinder part 149 of second hub part 126*b*, and second inducer 125*b* is secured to rotary shaft 107 by nut 112 from the upper side of cylinder part 149. Moreover, upper surface 152 of first hub part 126*a* is disposed to be proximally covered by lower surface 153 of nut 112. With this configuration, it is possible to configure such that the tightening force is not applied only to first inducer 125*a*, when impeller 120 is secured to rotary shaft 107 by the fastener such as nut 112. It is possible to configure such that first inducer 125*a* is made thin, and that resin inducer 125 has a multi-blade configuration which is applicable to volume production using a mold with a simple configuration.

Moreover, second inducer 125*b* is secured to rotary shaft 107 by nut 112. First inducer 125*a* is provided with means that prevents or restricts the first inducer from moving both in the direction of rotary shaft 107 and in the direction along the circumference of rotary shaft 107. Therefore, second blade parts 127*b* and first blade parts 127*a* do not move out of position. This does not cause air turbulence leading to a decrease in air blowing performance.

It is to be noted that, in the first embodiment, although inducer 125 is configured with the two vertical parts, the inducer may be configured with three or more vertical parts, such as when the number of the blade parts of inducer 125 is further increased. Even in this case, the inducer's parts except one located at the lowest position among them can be made thin; therefore, resin inducer 125 is formed using a mold with a simple configuration.

Second Exemplary Embodiment

Figure 8:
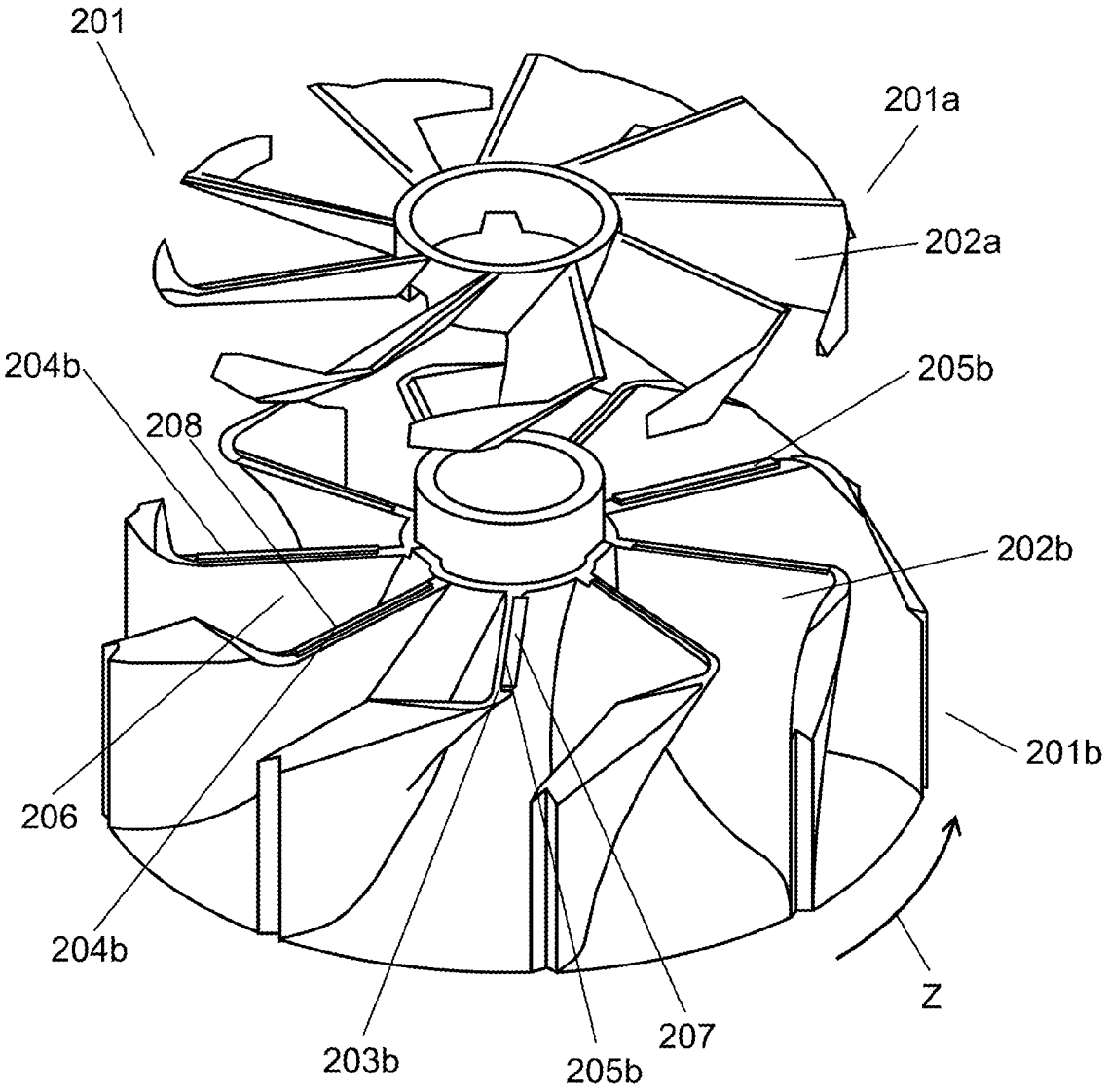
FIG. 8 is a perspective view of an inducer of an electric blower of a second embodiment according to the invention.
Figure 9:
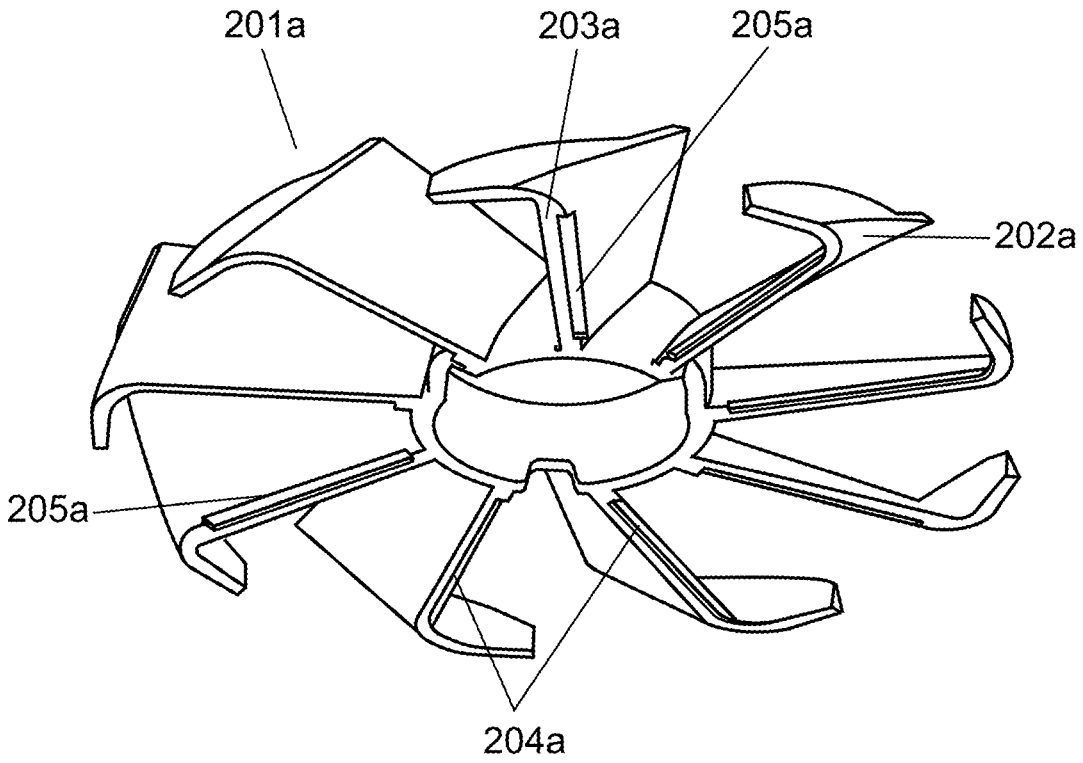
FIG. 9 is a perspective backside view of a first inducer of the electric blower.

FIG. 8 is a perspective view of an inducer of an electric blower of a second embodiment according to the present invention. FIG. 9 is a perspective backside view of a first inducer of the electric blower. In the second embodiment of the invention, only differences from the first embodiment are described.

In the second embodiment of the invention, the differences from the first embodiment are as follows: Stair-like third steps 204*a*, serving as engaging parts, are disposed in mating surfaces 203*a* of first blade parts 202*a* of first inducer 201*a*. Moreover, stair-like fourth steps 204*b* with first projections 145 shown in FIG. 7 are disposed in mating surfaces 203*b* of second blade parts 202*b* of second inducer 201*b*, in the negative pressure surface 208 side of second blade parts 202*b*. Fourth steps 204*b* engage third steps 204*a*.

Moreover, of mating surfaces 203*b*, in a part of mating surfaces 203*b*, stair-like fifth steps 205*b* with second projections 207 are disposed in the pressure surface 206 side of second blades parts 202*b*. Stair-like sixth steps 205*a*, serving as engaging parts for engaging fifth steps 205*b*, are disposed in mating surfaces 203*a* of first blade parts 202*a*.

In the second embodiment, in a part of mating surfaces 203*b*, second projections 207 are disposed in the pressure surface 206 side of second blade parts 202*b*. In this way, these projections are disposed in a co-existent manner, i.e. fourth steps 204*b* disposed in the negative pressure surface 208 side and fifth steps 205*b* disposed in the pressure surface 206 side. Then, it is configured that fifth steps 205*b* engage sixth steps 205*a*. Accordingly, when assembling, first inducer 201*a* is prevented from moving out of position relative to second inducer 201*b*, in both the backward and forward rotational directions indicated by arrow Z. As a result, first inducer 201*a* and second inducer 201*b* are assembled together without any out-of-position error.

Third Exemplary Embodiment

Figure 10:
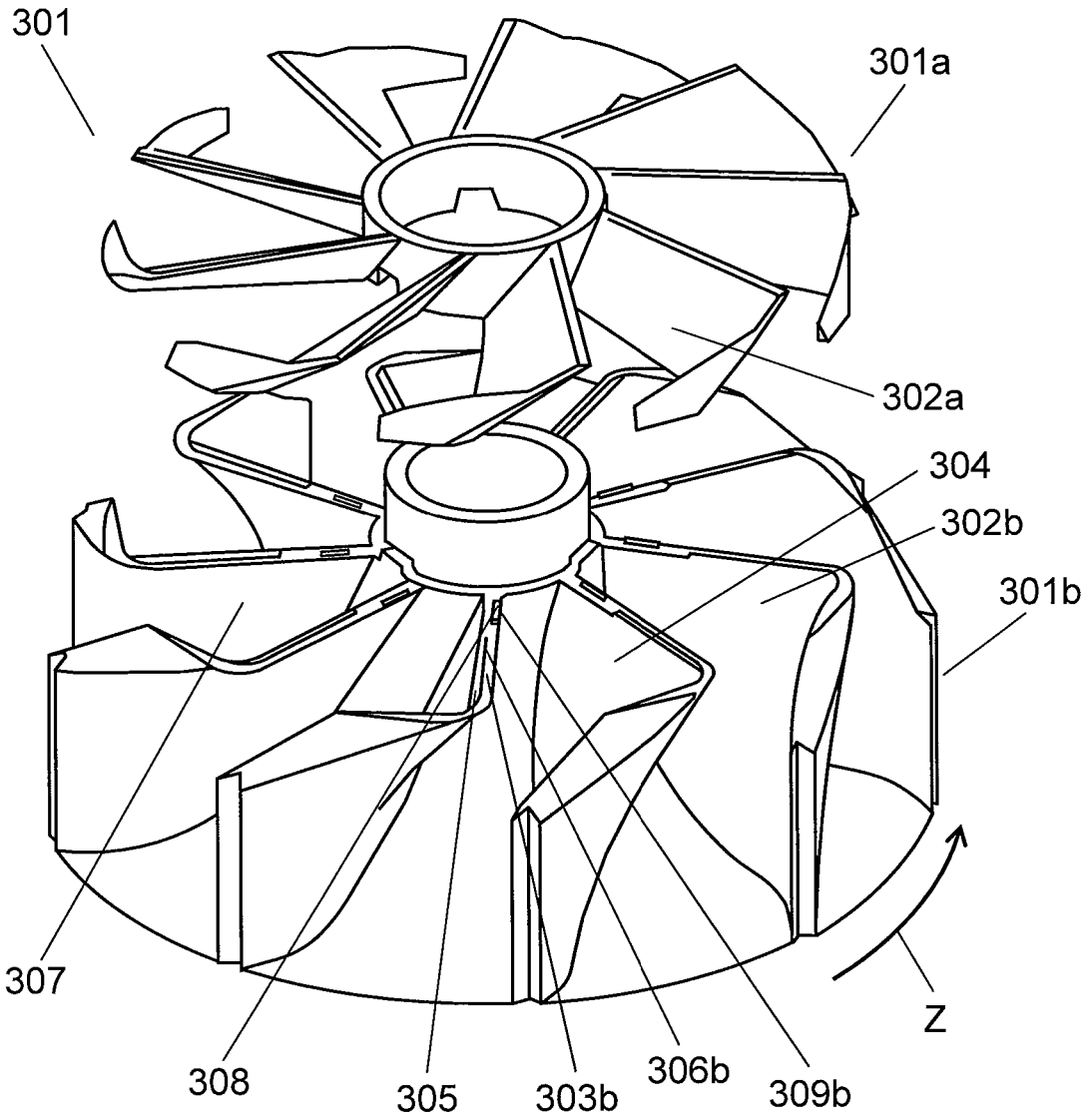
FIG. 10 is a perspective view of an inducer of an electric blower of a third embodiment according to the invention.
Figure 11:
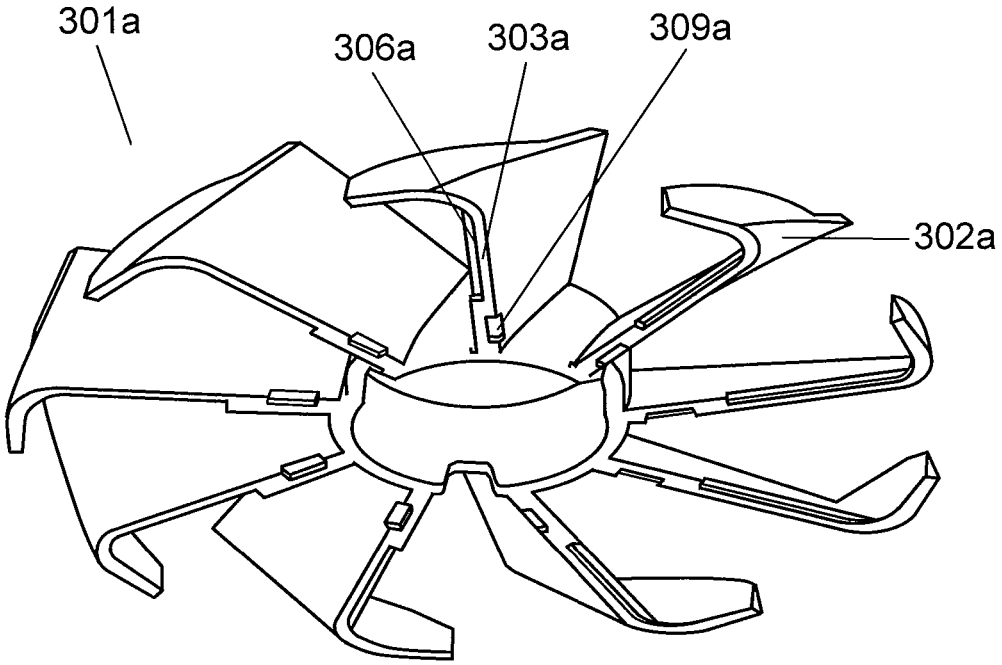
FIG. 11 is a perspective backside view of a first inducer of the electric blower.

FIG. 10 is a perspective view of an inducer of an electric blower of a third embodiment according to the invention. FIG. 11 is a perspective backside view of a first inducer of the electric blower. In the third embodiment of the invention, only differences from the first embodiment are described.

In the third embodiment of the invention, the differences from the first embodiment are as follows: Mating surfaces 303*a* and 303*b* are disposed in first blade parts 302*a* of first inducer 301*a* and second blade parts 302*b* of second inducer 301*b*, respectively. Moreover, third projections 305 and fourth projections 308 are disposed in mating surfaces 303*b*. Third projections 305 are disposed in the negative pressure surface 304 side in the outer periphery side of second blade parts 302*b*. Fourth projections 308 are disposed in the pressure surface 307 side in the inner periphery side of second blade parts 302*b*.

Seventh steps 306*b* are formed of third projections 305, and eighth steps 306*a* are formed in mating surfaces 303*a* at positions corresponding to seventh steps 306*b*. Moreover, ninth steps 309*b* are formed with fourth projections 308, and tenth steps 309*a* are formed in mating surfaces 303*a* at positions where corresponding to ninth steps 309*b*. In the third embodiment of the invention, the engaging parts are configured with seventh steps 306*b* and eighth steps 306*a*, and configured with ninth steps 309*b* and tenth steps 309*a*. The lengths of eighth steps 306*a* and seventh steps 306*b* are larger in the radial direction of inducer 301 than those of tenth steps 309*a* and ninth steps 309*b*.

In the third embodiment, mating surfaces 303*a* and 303*b* are provided respectively with eighth steps 306*a* and seventh steps 306*b*, and respectively with tenth steps 309*a* and ninth steps 309*b*. Accordingly, when assembling first inducer 301*a* and second inducer 301*b*, these inducers are locked in place in blade parts 302, due to eighth steps 306*a* and seventh steps 306*b* and due to tenth steps 309*a* and ninth steps 309*b*. As a result, first blade parts 302*a* and second blade parts 302*b* are assembled together without any out-of-position error.

Moreover, being different from the second embodiment, the embodiment allows all of blade parts 302 to employ the same configuration of shapes of their steps, in such a manner as follows: First blade parts 302*a* are provided with eighth steps 306*a* and tenth steps 309*a*, while second blade parts 302*b* are provided with seventh steps 306*b* and ninth steps 309*b*. Accordingly, inducer 301 of the third embodiment is superior in forming accuracy to inducer 201 of the second embodiment.

With this configuration, force caused by the rotation of the impeller (not shown) to pressure surfaces 307 of blade parts 302 is stronger in the outer periphery side than that in the other, where blades' peripheral velocity becomes large. Therefore, third projections 305 are disposed in the negative pressure surface 304 side in the outer periphery side of second blade parts 302*b*. Moreover, eighth steps 306*a* and seventh steps 306*b* are longer than tenth steps 309*a* and ninth steps 309*b*. As a result, first inducer 301*a* is prevented from moving out of second inducer 301*b*, in the direction opposite to the rotational direction indicated by arrow Z.

Fourth Exemplary Embodiment

Figure 12:
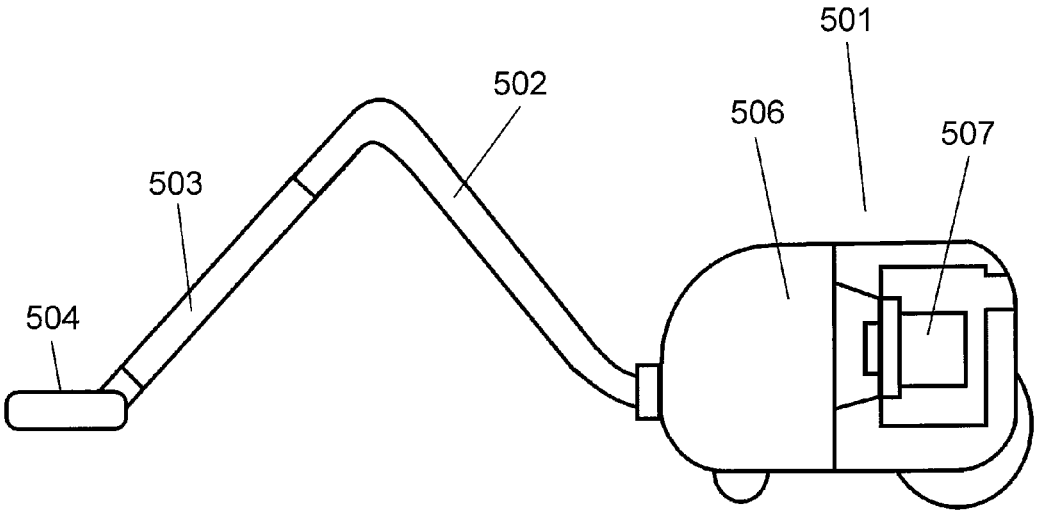
FIG. 12 is a general configuration view of an electric cleaner of a fourth embodiment according to the invention.
Figure 13:
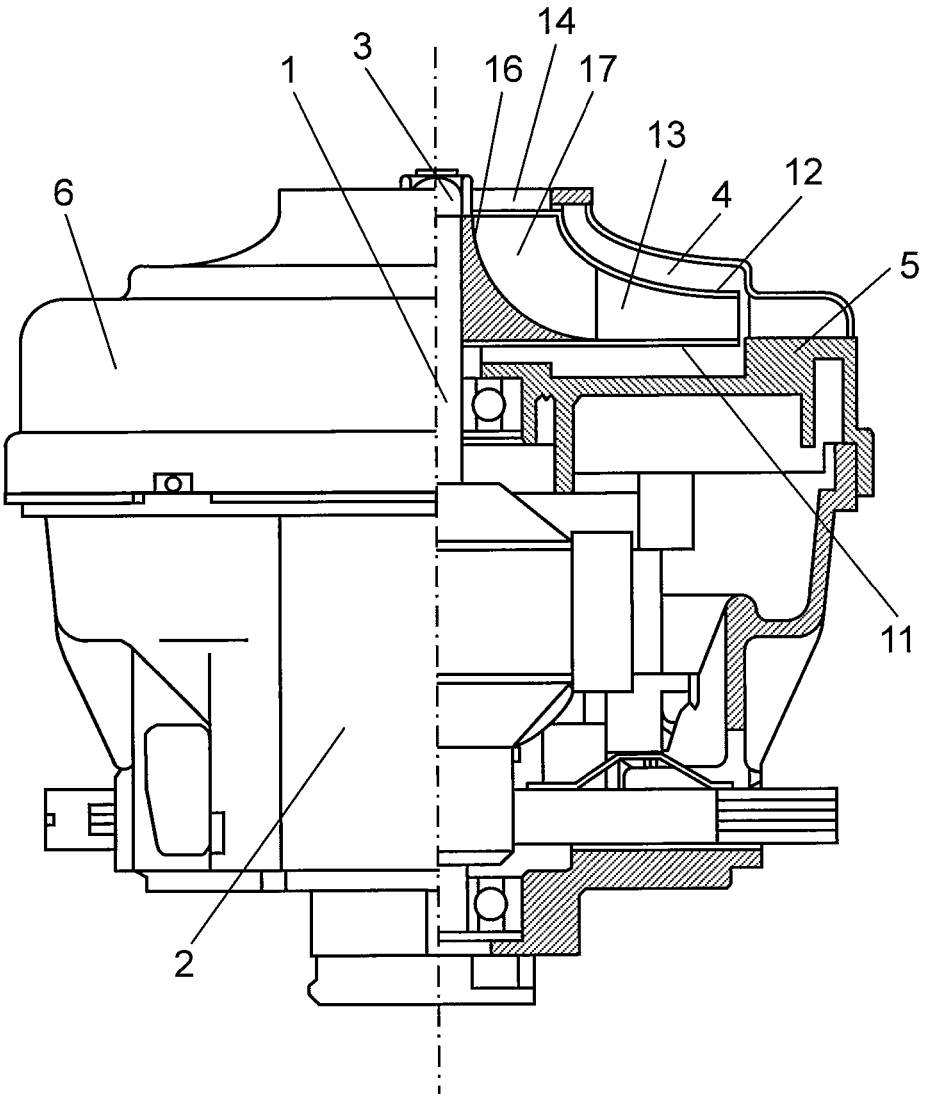
FIG. 13 Prior Art
FIG. 13 is a partial cross-sectional view of a conventional electric blower.
Figure 14:
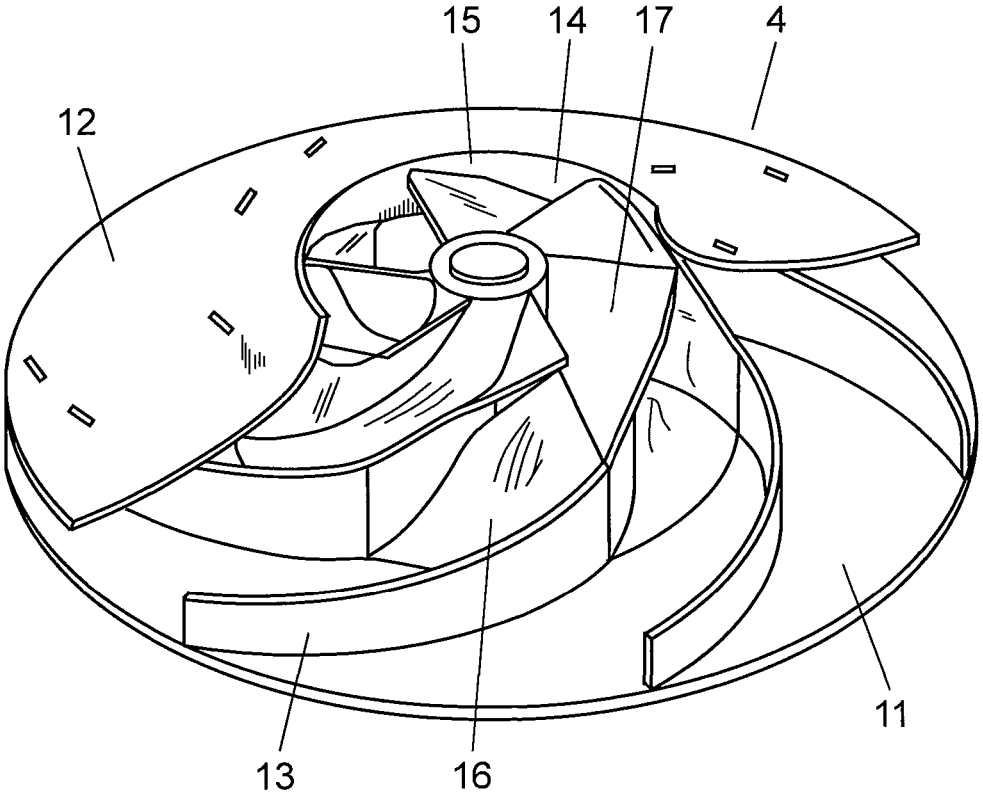
FIG. 14 Prior Art
FIG. 14 is a partial cross-sectional view of an impeller of the electric blower.
Figure 15A:
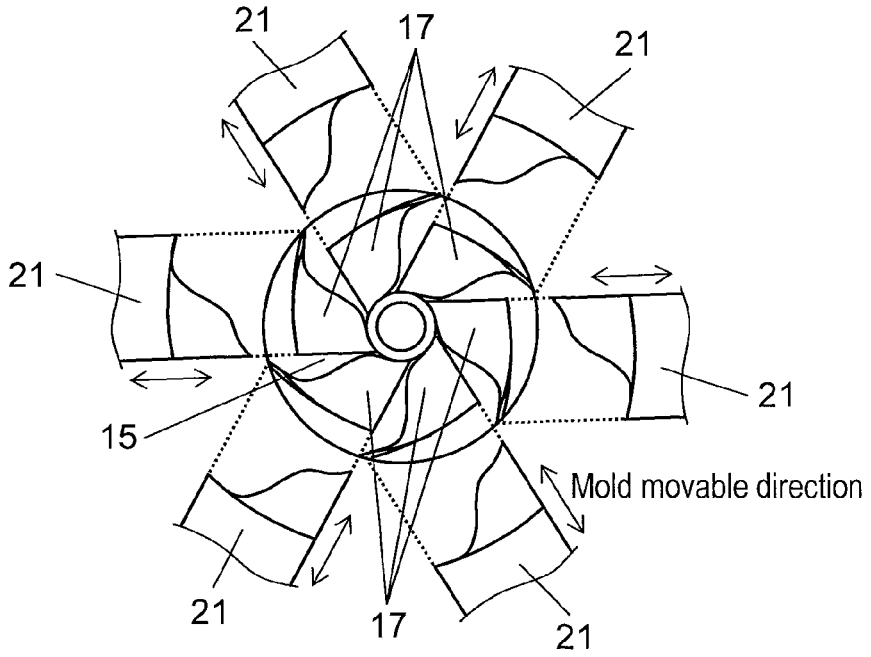
FIG. 15A Prior Art
FIG. 15A is a plan view of a structure of a mold for an inducer of the electric blower.
Figure 15B:
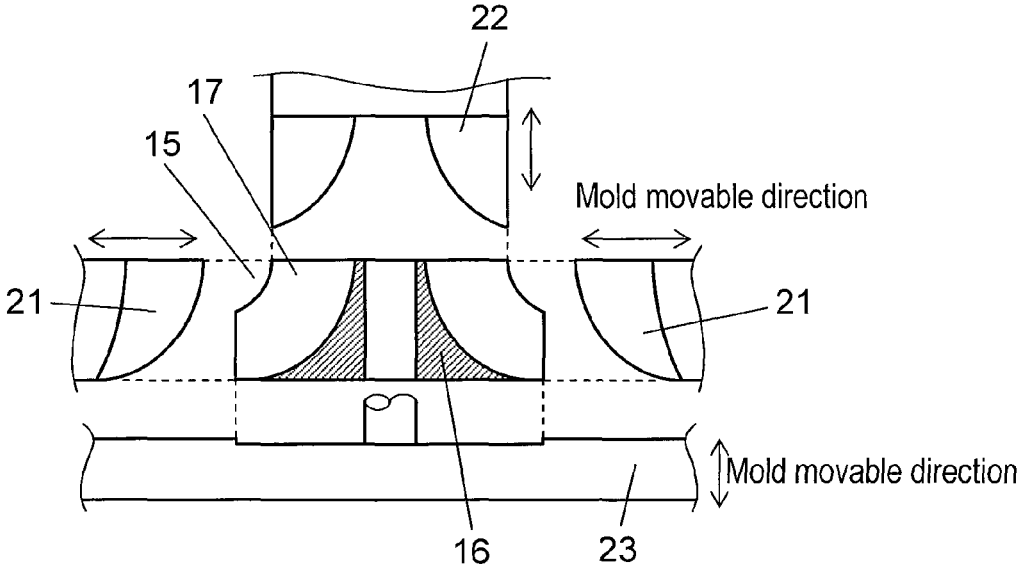
FIG. 15B Prior Art
FIG. 15B is a side elevational view of the structure of the mold for the inducer of the electric blower.
Figure 16:
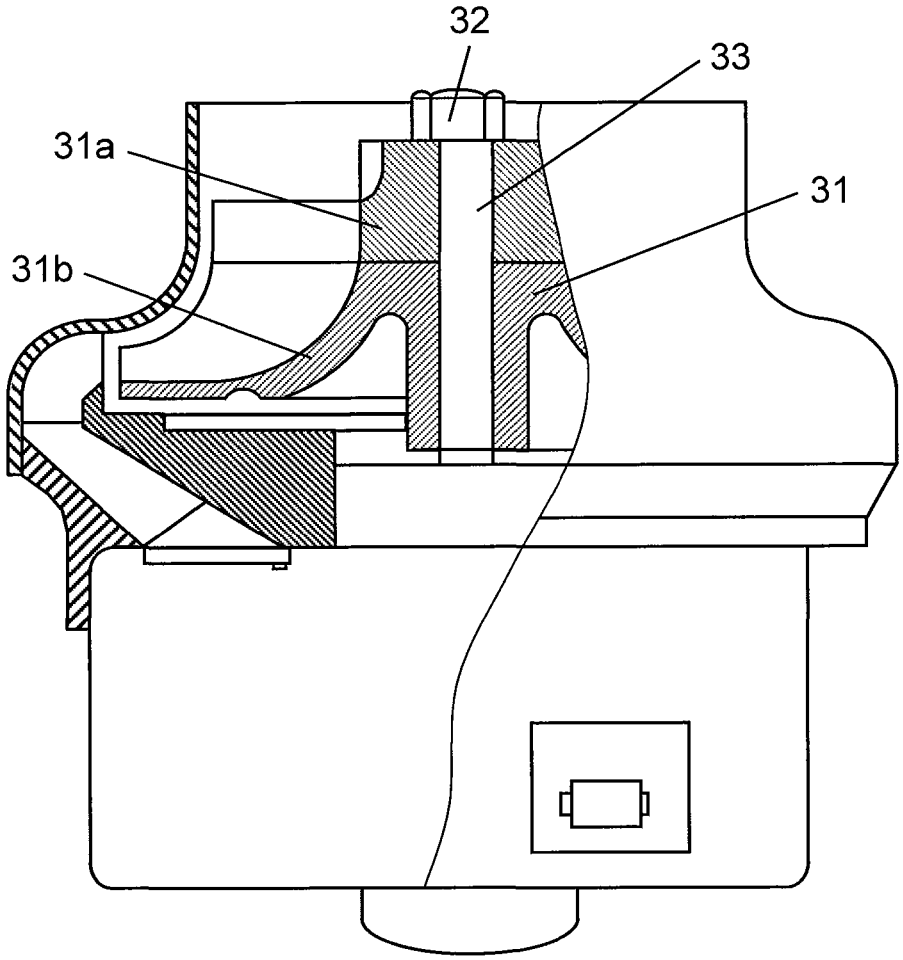
FIG. 16 Prior Art
FIG. 16 is a partial cross-sectional view of a conventional electric blower having another configuration.
Figure 17A:
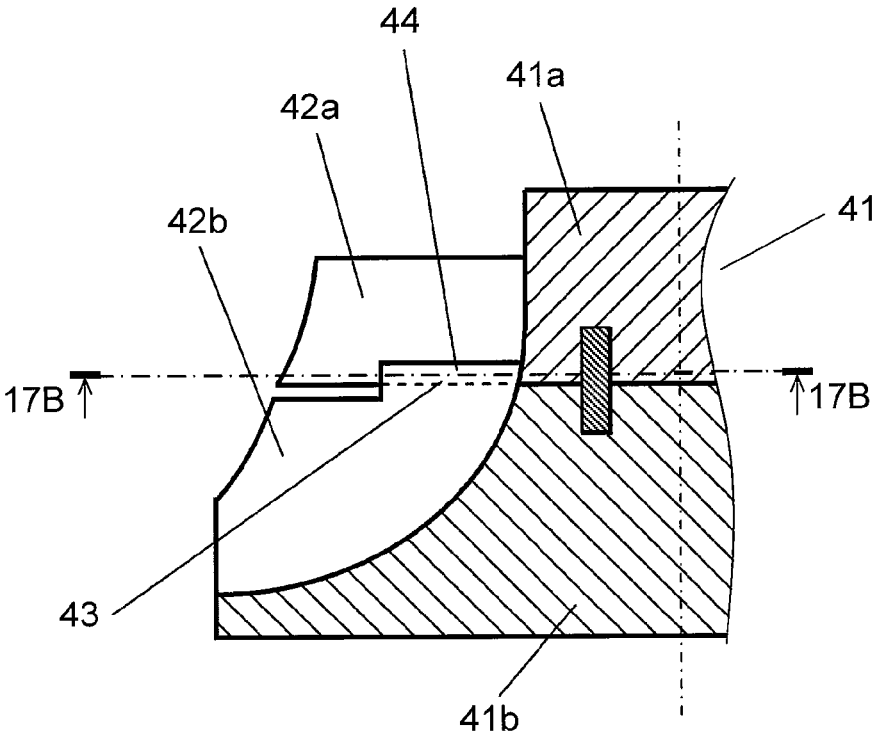
FIG. 17A Prior Art
FIG. 17A is a cross-sectional view of an inducer of a conventional electric blower having further another configuration.
Figure 17B:
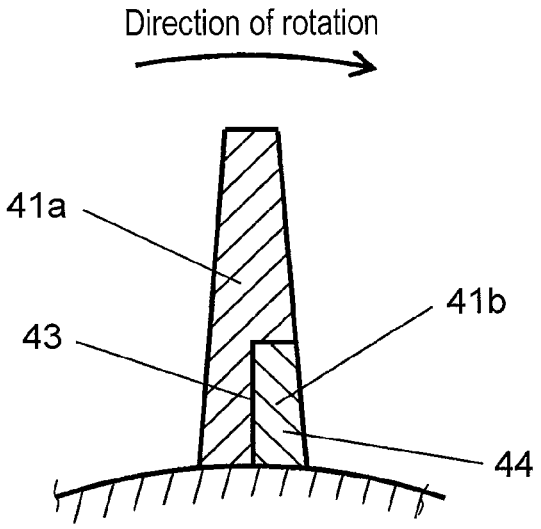
FIG. 17B Prior Art
FIG. 17B is a cross-sectional view taken along line 17B-17B in FIG. 17A.

FIG. 12 is a general configuration view of an electric cleaner of a fourth embodiment according to the invention.

Electric cleaner 501 includes: hose 502, extension tube 503 and suction unit 504 that moves on the floor to suck-in dust, and cleaner body 506. Cleaner body 506 accommodates electric blower 507 including the inducer (not shown) described in any of the first to third embodiments.

Hereinafter, a description is made regarding operation and functions of thus configured electric cleaner 501.

First, upon starting up electric cleaner 501, electric blower 507 blows air. Electric blower 507 accommodates the inducer (not shown) described in any of the first to third embodiments, with the inducers having a relatively large number of blades. This reduces noises at frequencies which are unpleasant for users. Moreover, when assembling electric blower 507 and using it, a reduction is prevented in performances of air-blowing caused by the inducers (not shown) moving out of position. As a result, electric cleaner 501 is of lower noise and powerful suction, and then becomes very practical.

INDUSTRIAL APPLICABILITY

As described above, the electric blower according to the present invention and the electric cleaner using the blower allow the multi-blade configuration of their resin inducers which are applicable to volume production using a mold with a simple configuration. Hence, they are applicable to business uses as well as household uses.

The invention claimed is:

1. An electric blower, comprising:

a motor having a rotary shaft; and an impeller rotationally driven by the motor, the impeller including:

a front shroud having a suction opening;

a rear shroud disposed with a space from the front shroud;

a plurality of sheet-metal blades fitted to and fixed between a pair of the front shroud and the rear shroud; and a resin inducer disposed at a center portion of the impeller, the resin inducer including:

a cone-shaped hub part; and a plurality of blade parts in a periphery of the hub part, the resin inducer rectifying suction-air flow taken from the suction opening, the resin inducer being divided into two parts in a plane perpendicular to the rotary shaft, the two parts being a first inducer and a second inducer, the first inducer including:

a ring-shaped first hub part forming the hub part and comprising a first fitting part; and a plurality of first blade parts forming the blade parts, the first inducer being located upstream close to the suction opening in a passage of the suction-air flow, the second inducer including:

a cone-shaped second hub part forming the hub part and comprising a second fitting part engaging with the first fitting part; and a plurality of second blade parts forming the blade parts, the second inducer being located downstream farther away from the suction opening than the first inducer in the passage of the suction-air flow, the second blade parts and the first blade parts each having a mating surface, the second blade parts and the first blade parts being mated and assembled to each other at the respective mating surfaces, the mating surfaces each having an engaging part for mating the second blade parts and the first blade parts, the first hub part being disposed around an outer periphery of the second hub part, the second inducer being secured to the rotary shaft by a fastener from a first hub part side, the second blade parts and the first blade parts being guided to assemble by the first and the second fitting parts and coupled to each other at the engaging parts, wherein outer-peripheral blade-tips of the first blade parts are disposed in a proximity of the front shroud, an upper surface of the first hub part is disposed to be proximally covered by a lower surface of the fastener, and a height of the second hub part is one of equal to and larger than a height of the first hub part, with the first hub part disposed around the outer periphery of the second hub part, whereby the first inducer is restricted from moving both in an axial direction of the rotary shaft and in a rotational direction of the rotary shaft.

2. The electric blower according to claim 1, wherein the engaging parts include:

first steps disposed in the first blade parts; and second steps engaging with the first steps, the second steps each disposed as a first projection in a negative pressure surface side of the second blade parts.

3. The electric blower according to claim 1, wherein the engaging parts include:

third steps disposed in the first blade parts; and fourth steps engaging with the third steps, the fourth steps each disposed as a first projection in a negative pressure surface side of the second blade parts, and include:

sixth steps disposed in the first blade parts; and fifth steps engaging the sixth steps, the fifth steps being located in a pressure surface side of the second blade parts.

4. The electric blower according to claim 1, wherein the engaging parts include:

seventh steps each having a third projection in a negative pressure surface side in an outer periphery side of the second blade parts; and eighth steps engaging the seventh steps, the eighth steps being disposed in the first blade parts, and include:

ninth steps each having a fourth projection in a pressure surface side in an inner periphery side of the second blade parts; and tenth steps engaging the ninth steps, the tenth steps being disposed in the first blade parts.

5. The electric blower according to claim 1, wherein the mating surfaces of the engaging parts are mated to each other in a vertical plane, the mating surfaces being located in a direction along a circumference of the rotary shaft.

6. The electric blower according to claim 1, wherein a height of the first and the second fitting parts is larger in an axial direction of the rotary shaft than that of the engaging parts.

7. The electric blower according to claim 1, wherein the second hub part is provided with a cylinder part, the cylinder part is inserted on outer periphery of the rotary shaft, the first hub part is inserted on outer periphery of the cylinder part, and the cylinder part is not shorter than the first hub part in the axial direction of the rotary shaft.

8. The electric blower according to claim 7, wherein an outside diameter of the fastener is larger than an inside diameter of the first hub part, the second inducer is secured to the rotary shaft by the fastener from an upper side of the cylinder part, and an upper surface of the first hub part is disposed to be proximally covered by a lower surface of the faster.

9. The electric blower according to claim 1, wherein the first blade parts of the first inducer and the second blade parts of the second inducer, and the second blade parts neighboring the first blade parts of the first inducer, overlap with each other.

* * * * *